US006721518B2

(12) United States Patent
Oshida et al.

(10) Patent No.: US 6,721,518 B2
(45) Date of Patent: Apr. 13, 2004

(54) THERMAL FUSER AND IMAGE FORMATION APPARATUS

(75) Inventors: Hideo Oshida, Iwatsuki (JP); Yasuki Tanaka, Iwatsuki (JP); Keiji Sanekata, Iwatsuki (JP); Hitoshi Nanba, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/988,362

(22) Filed: Nov. 19, 2001

(65) Prior Publication Data

US 2002/0061201 A1 May 23, 2002

(30) Foreign Application Priority Data

Nov. 20, 2000 (JP) ..... 2000-353164
Nov. 20, 2000 (JP) ..... 2000-353171
Oct. 18, 2001 (JP) ..... 2001-320963

(51) Int. Cl.[7] ..... G03G 15/20
(52) U.S. Cl. ..... 399/69; 399/328
(58) Field of Search ..... 399/21, 33, 67, 399/69, 70, 122, 320, 328, 330, 331, 332; 219/216, 244, 469, 471

(56) References Cited

U.S. PATENT DOCUMENTS 4,740,671 A * 4/1988 Kuroda et al. ..... 219/497 X
5,118,920 A * 6/1992 Tanabe et al. ..... 219/216
5,633,704 A * 5/1997 Suzuki et al. ..... 399/69
5,701,556 A * 12/1997 Sugimoto ..... 399/70
5,737,664 A * 4/1998 Fukuda et al. ..... 399/33
5,802,421 A * 9/1998 Miura ..... 399/33
5,848,319 A * 12/1998 Morigami et al. ..... 399/21 X
6,185,388 B1 * 2/2001 Yamamoto ..... 399/69

FOREIGN PATENT DOCUMENTS

JP B2 4-39077 6/1992
JP B2 4-77313 12/1992
JP B2 4-77314 12/1992
JP A 5-333744 12/1993

* cited by examiner

*Primary Examiner*—Hoan Tran
(74) *Attorney, Agent, or Firm*—Oliff & Berridge, PLC

(57) ABSTRACT

The part of a halogen heater 90 corresponding to the position of a temperature sensing member 110 is positioned at a part where the temperature gradient of light distribution ripple 120 along the length direction of the halogen heater 90 is moderate (a top 122 or a bottom 124).

12 Claims, 22 Drawing Sheets

THERMAL FUSER AND IMAGE FORMATION APPARATUS

BACKGROUND OF THE INVENTION

1. Field of the Invention

This invention relates to a thermal fuser and an image formation apparatus.

2. Description of the Related Art

A thermal fuser of an image formation apparatus comprises an excessive temperature rising prevention device such as a thermostat, a temperature fuse, or the like in series with a heating source to prevent a heating roll from being excessively heated (excessive temperature rising) because of a failure of a temperature sensing member or a failure of a controller for controlling turning on/off power supplied to the heating source or voltage.

JP-B-Hei.4-39077 and JP-B-Hei.4-77313 disclose arts wherein when temperature excessively rises, a bearing or a frame for supporting a heating roll softens, whereby the heating roll is brought closely to an excessive temperature rising prevention device for preventing a rapid excessive temperature rising. The arts involve the following problem: If the heating roll is made thin, thermal conductivity in an axial direction of the heating roll is worsened as the heating roll is made thinner and thus the temperature of the bearing, etc., supporting the heating roll is hard to rise and the bearing, etc., is hard to soften and therefore an intended result cannot be produced.

JP-B-Hei.4-77314 disclose an art wherein an excessive temperature rising prevention device is installed in an axial end part of a heating roll and when the heating roll is thermally expanded axially, the heating roll is brought closely to the excessive temperature rising prevention device, thereby preventing a rapid excessive temperature rising. The art involves the following problem: As the heating roll is made thinner, thermal conductivity in the axial direction of the heating roll is worsened and thus when an excessive temperature rising rapidly occurs, the temperature of the end part of the heating roll is too low and the excessive temperature rising prevention device does not operate.

JP-A-Hei.5-333744 discloses an art discloses an art wherein a temperature control circuit and a circuit for shutting down power to a heater when an excessive temperature rising occurs are provided separately; the art has a problem of leading to an increase in costs.

It is common practice to use a halogen heater as a heating source of a thermal fuser of an image formation apparatus. The halogen heater is a heater provided by winding a wire material including tungsten as a main component like a coil having proper sparse and dense portions to form a filament and sealing the filament in a quartz glass column together with halogen mix gas.

In the image formation apparatus, thinning a heating roll for lessening the heat capacity of the heating roll is developed for the purposes of shortening the warming-up time at the starting time and saving energy. In recent years, a large number of heating rolls with iron as a material have been become commercially practical to compensate for the strength resulting from thinning the heating roll. Thinning the heating roll and selecting iron as the material cause the thermal conductivity of the heating roll to be lowered and temperature unevenness in the axial direction of the heating roll to be increased.

The art of thinning the heating roll of the image formation apparatus to lessen the heat capacity of the heating roll is developed for shortening the warming-up time and saving energy. As the heat capacity of the heating roll is lessened, a temperature rising of the heating roll when an abnormal temperature rising occurs becomes too large and the apparatus easily falls in a dangerous state of catching fire, etc., before the excessive temperature rising prevention device operates; this is a problem.

As means for preventing this, the excessive temperature rising prevention device may be brought near to the heating roll or the operating temperature of the excessive temperature rising prevention device may be lowered, thereby hastening the operation of the excessive temperature rising prevention device when an abnormal temperature rising occurs. In either case, however, it is feared that the excessive temperature rising prevention device may malfunction during the operation of print, etc., making it impossible to normally use the apparatus; this is a problem.

As one problem involved when axial temperature unevenness occurs in the heating roll, when the relative positional relationship between the filament forming a part of the halogen heater and the temperature sensing member changes, a temperature sensing failure occurs. This is caused by the fact that the surface light distribution of the heating roll changes from one point to another depending on the sparseness and denseness of the filament. In the dense portion of the filament, the surface temperature of the heating roll becomes high as compared with its surroundings; in the sparse portion of the filament, the surface temperature of the heating roll becomes low as compared with its surroundings. Therefore, as the whole heating roll, the temperature controlled by the temperature sensing member varies depending on which of the sparse and dense portions of the filament comes to the portion in which the temperature sensing member exists. Taking variations in quality at mass production time of halogen heaters, variations caused by tolerance of the halogen heater attachment part, and the like into consideration, this is not a negligible value.

Another problem is an excessive rising in the temperature of a portion through which no paper passes when narrow paper is printed. To prevent this, an art of printing while selectively changing a plurality of halogen heaters different in light distribution has been known. Even in the art, however, when the halogen heaters are changed, a fixing failure or hot offset may occur depending on the rotation direction of the heating roll and the relative positional relationship between the temperature sensing member and the halogen heater, and therefore this leads to a problem on image quality.

SUMMARY OF THE INVENTION

It is an object of the invention to solve the above-described problems by devising placement of a heating source to thin a heating roll for lessening the heat capacity of the heating roll and provide an excellent thermal fuser and an excellent image formation apparatus without producing any disadvantage by simple improvement in the configuration.

To accomplish the object, according to a first aspect of the invention, there is provided a thermal fuser comprising: a heating source; a heating roll containing the heating source; a pressure member disposed to press-contact with the heating roll; a temperature sensing member for sensing temperature of the heating roll; a temperature controller for controlling electric power supplied to the heating source based on the temperature sensed by the temperature sensing member;

and an excessive temperature rising prevention device disposed in the proximity of the heating roll and connected in series to the heating source, wherein the heating sources is disposed at a position close to the excessive temperature rising prevention device from the center of the heating roll.

In this case, the thermal fuser is characterized by the fact that the heating source has bend parts in the proximity of both ends thereof; a portion of the heating source through which paper passes is made eccentric; and the eccentric portion is disposed to be close to the excessive temperature rising prevention device side from the center of the heating roll. In the thermal fuser, it is preferable that the heating source is a plurality of heating sources. The heating value of the heating source disposed to be the closer to the excessive temperature rising prevention device from the center of the heating roll, is larger. In the thermal fuser, it is preferable that a heating source with a wider effective heating range is disposed more downstream in a rotation direction of the heating roll viewed from the excessive temperature rising prevention device. In the thermal fuser, it is preferable that a flow passage shape for making the amount of cooling air passing through the proximity of the excessive temperature rising prevention device larger than that through any other portion is provided.

Next, according to a second aspect of the invention, there is provided a thermal fuser comprising: a heating roll containing a halogen heater; a pressure member disposed to press-contact with the heating roll; a temperature sensing member for sensing temperature of the heating roll; and a temperature controller for controlling electric power supplied to the halogen heater based on the temperature sensed by the temperature sensing member, wherein the thinnest portion of the heating roll in an area through which paper passes is not more than 0.5 mm; and a part of the halogen heater corresponding to a position of the temperature sensing member is positioned at one of a top and a bottom of a local light distribution ripple in an axial direction of the halogen heater.

According to a third aspect of the invention, the thermal fuser according to the second aspect of the invention, wherein the halogen heater is a plurality of halogen heaters different in light distribution; the halogen heaters are changed in response to print conditions to conduct fixing; for the halogen heater upstream in a rotation direction of the heating roll viewed from the temperature sensing member, the bottom of the local light distribution ripple in the axial direction is placed at the position corresponding to the temperature sensing member; and for the halogen heater downstream in the rotation direction of said heating roll viewed from said temperature sensing member, the top of the local light distribution ripple in the axial direction is placed at the position corresponding to the temperature sensing member.

Further, according to a fourth aspect of the invention, there is provided a thermal fuser comprising: a heating roll containing a heating source having difference in light emission amount in a length direction, a pressure member disposed to press-contact with the heating roll; a temperature sensing member for sensing temperature of the heating roll; and a temperature controller for controlling electric power supplied to the heating source based on the temperature sensed by the temperature sensing member, wherein the thickness of an area of the heating roll through which paper passes is thin; and a part of the heating source corresponding to a position of the temperature sensing member is positioned at a part where a temperature gradient of the heating source is moderate.

In the fourth aspect of the invention, the thickness of the area through which paper passes is may be to such an extent that a temperature gradient appears based on the light emission amount difference of the heating source in a length direction of the heating roll in the proximity of the part where the temperature sensing member is placed, and the thinnest portion in the area through which paper passes may be not more than 0.5 mm. Further, preferably the heating source is a heater comprising light emitting parts and non-light emitting parts placed alternately in the length direction of the heating source and the part where the temperature gradient is moderate is a portion corresponding to one of the light emitting part and the non-light emitting part.

Further, according to the invention, there is provided an image formation apparatus comprising any of the thermal fusers described above.

The image forming apparatus of the invention comprises a sequence controller for shutting down power supply of a heating source when an image formation process is stopped midway, and then stopping rotation of a heating roll after the expiration of a setup time interval, whereby providing a still thinner heating roll is facilitated.

DETAILED DESCRIPTION OF THE PREFERRED EMBODIMENTS

In the invention, for example, a unit for controlling power on/off, voltage, etc., may be used as a unit for controlling the electric power supplied to a heating source based on the temperature sensed by a temperature sensing member. In a first embodiment, the heating source contained in the heating roll is placed closely to an excessive temperature rising prevention device from the center of the heating roll and the heating source has the larger heating value, the heating source is placed closer to the excessive temperature rising prevention device from the center of the heating roll. If the thickness of the heating roll is thinned, when a control circuit runs away for some reason, a problem of the excessive temperature rising prevention device incapable of responding to the runaway occurs. Particularly, when the roll stops and paper is caught in the roll, there is a possibility that the paper caught in the roll may catch fire, etc., to increase the danger. According to the first embodiment of the invention, the heating source is brought closely to the excessive temperature rising prevention device so that the danger can be circumvented.

A second embodiment of the invention is an art applied to a heating roll in which the thinnest portion thereof in the area through which paper passes is 0.5 mm or less. Such a limitation is placed because temperature unevenness occurs in a heating roll having a thickness of 0.5 mm or less although large temperature unevenness does not occur in the surface temperature of a thick heating roll.

Since the halogen heater comprises a filament having sparseness and denseness in a length direction, there is a phenomenon in which the external temperatures corresponding to the sparseness and denseness of the halogen heater form a wave-like distribution in the length direction of the heater. In the second embodiment of the invention, a local light distribution ripple in an axial direction of the halogen heater refers to the light distribution shape. A peak of the wave is called top and a low portion between waves is called bottom.

A third embodiment of the invention is an art for making appropriate placement of the halogen heaters corresponding to the temperature sensing member wherein a plurality of halogen heaters different in light distribution are contained and are changed for use in response to the paper size, etc.

A fourth embodiment of the invention is an art wherein when the heating source having a difference in light emission amount in the length direction is used and the heating roll is thinned, even if the attachment accuracy of the heating source contains a small error, the temperature control of the heating roll is placed in a proper range.

Hereinafter, description will be given on preferred embodiments of the invention with reference to the drawings.

Figure 26:
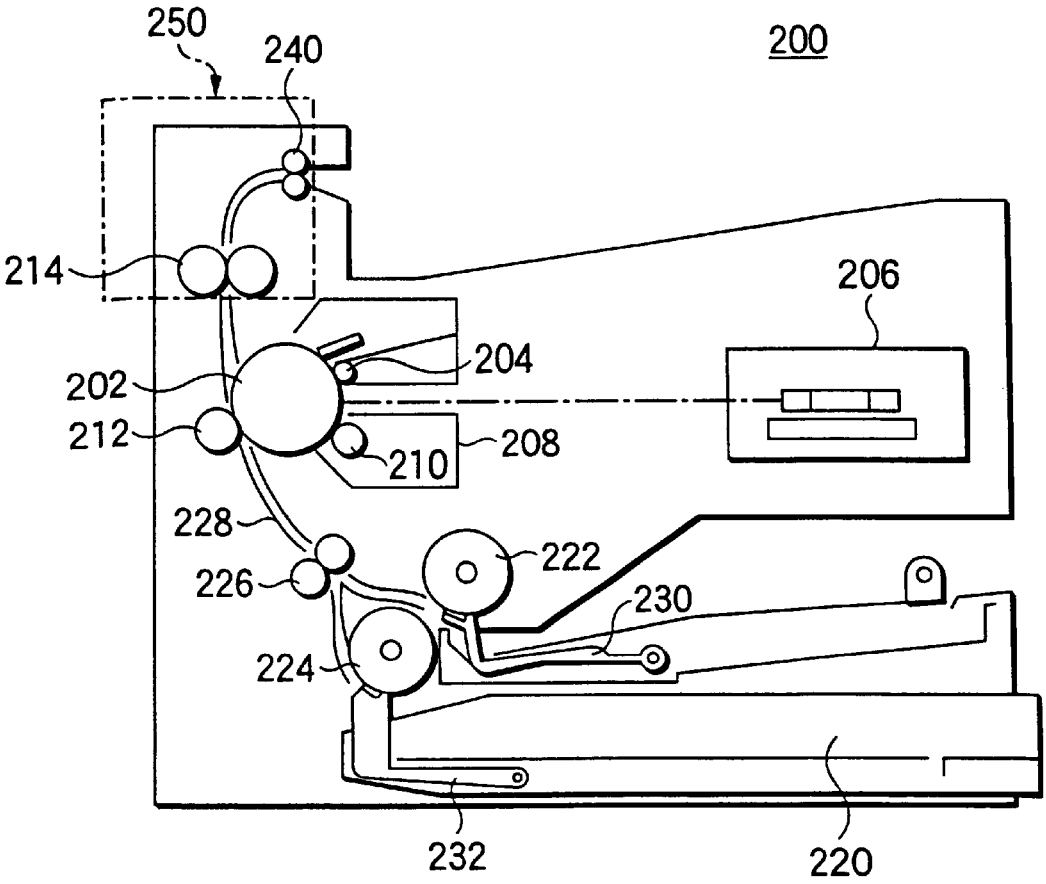
FIG. 26 is a schematic representation of the whole of an image formation apparatus.

FIG. 26 is a schematic representation to show the whole of an image formation apparatus 200 to which the invention is applied. The image formation apparatus 1 gives static electricity from an electrostatic roll 204 to a photoconductor drum 202 to charge the photoconductor drum 202, applies light of a laser, etc., from a light exposure device 206 to the photoconductor drum 202 to form a latent image on the photoconductor drum 202, and supplies powder with a developing roll 210 of a developing device 208 to develop an image on the photoconductor drum 202. Paper supplied via a paper supply passage 228 is passed through between the photoconductor drum 202 and a transfer roll 212 to transfer the image to the paper and then the image is fixed onto the paper by a fixing roll 214. On the paper supply passage 228, paper is taken out from a paper feed cassette 220, is advanced by feed rolls 222 and 224, is positioned by a registration roll 226, and is supplied to nip between the photoconductor drum 202 and the transfer roll 212 through the paper supply passage 228 at the paper feed timing. The paper to which the image is transferred is fixed by the fixing roll 214 and is ejected by an ejection roll 240. Numerals 230 and 232 denote paper sending levers. The invention is characterized by a thermal fuser 250 of the image formation apparatus 200.

Figure 25:
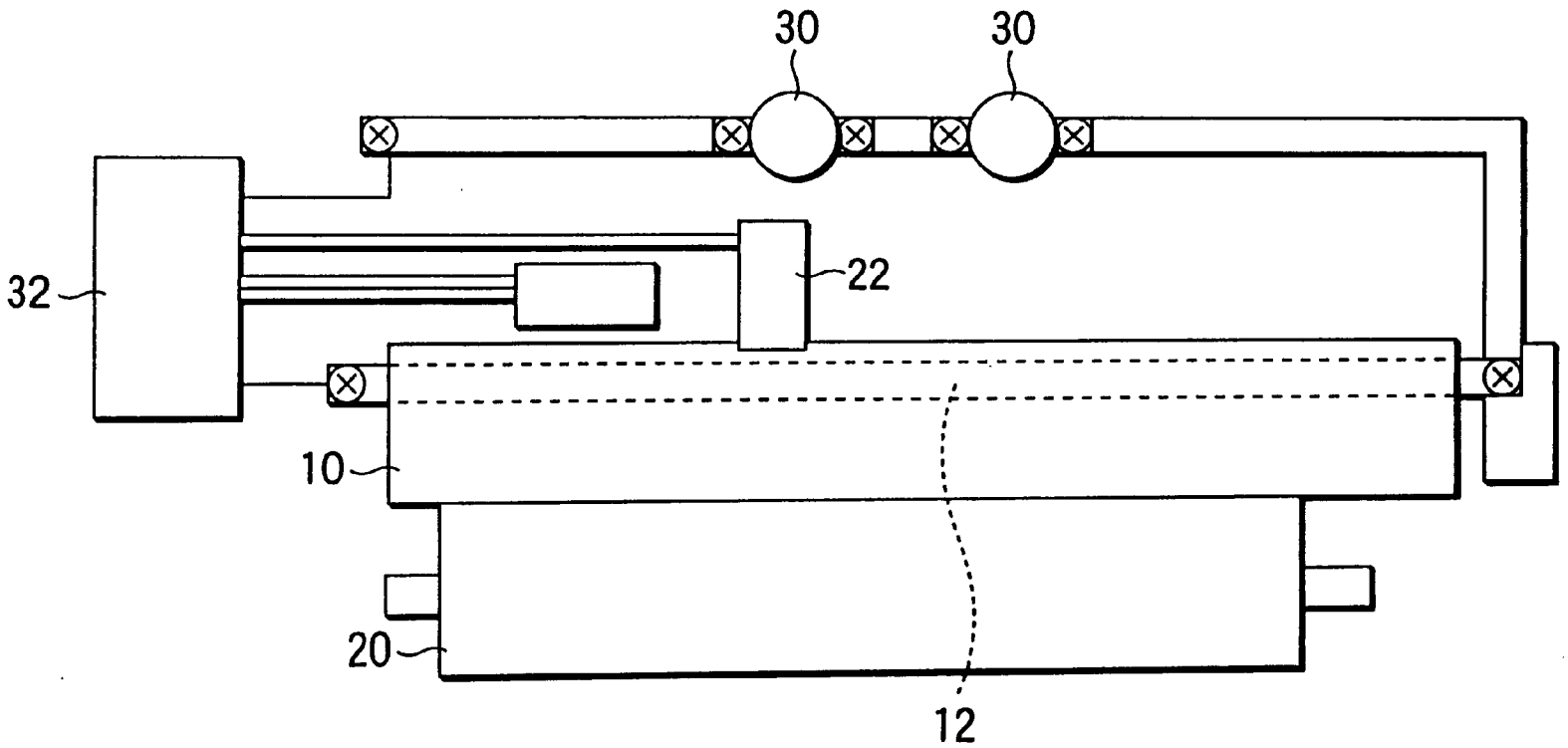
FIG. 25 is a circuit diagram of an excessive temperature rising prevention device.

FIG. 25 is a circuit diagram to show a system applied to the invention. A thermal fuser comprises a heating roll 10 containing a halogen heater 12 as a heating source, a pressure member 20 disposed to press-contact with the heating roll 10, a temperature sensing member 22 for sensing the temperature of the heating roll 10, a connector 32 of power supply for supplying power to the heating source (the halogen heater 12), and an excessive temperature rising prevention device 30 connected in series to the heating source (halogen heater 12) to prevent the heating roll 10 from being excessively heated. The temperature sensing member 22 comprises a temperature controller (not shown) for controlling power supplied to the heating source (halogen heater 12) based on the sensed temperature. In the first and third embodiments of the invention, the heating source (halogen heater 12) is installed closely to the excessive temperature rising prevention device 30 from the center of the heating roll 10. In the second and fourth embodiments of the invention, the heating source (halogen heater 12) maybe installed arbitrarily in the heating roller 10.

First Embodiment

Figure 1:
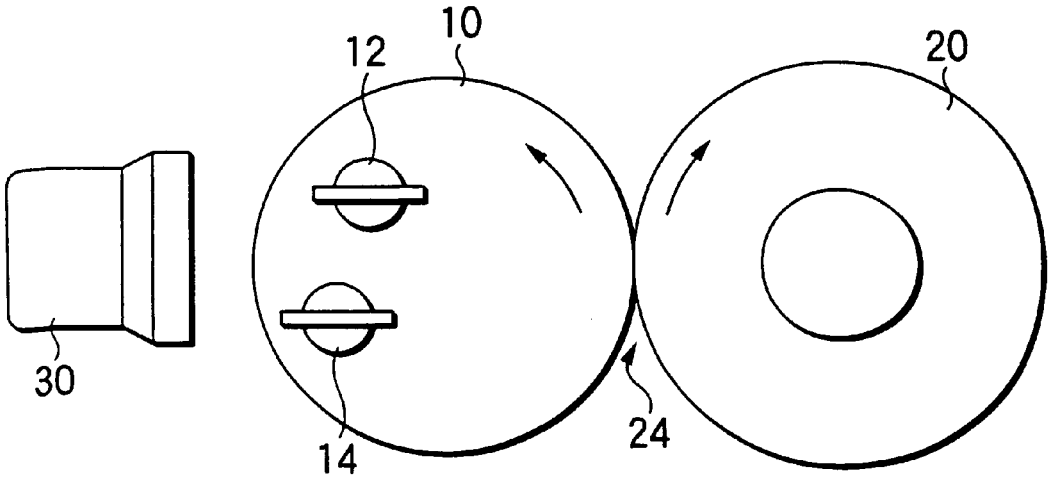
FIG. 1 is a transverse sectional view of a heating roll of an embodiment.

FIG. 1 shows the first embodiment of the invention and shows the cross section of the heating roll 10 and the pressure member 20. The heating sources (halogen heaters 12 and 14) are brought closely to the excessive temperature rising prevention device 30 from the center of the heating roll 10. The heating source has the larger heating value, the heating source is disposed closer to the excessive temperature rising prevention device 30.

As a problem arising particularly when an excessive temperature rising occurs, the heating and pressure rollers pair stops in a state in which paper is sandwiched between the heating roll 10 and the pressure member 20 to lead to paper catching fire. The heating sources (halogen heaters 12 and 14) are brought closely to the excessive temperature rising prevention device 30 and away from nip 24 between the heating roll 10 and the pressure member 20, whereby the temperature in the proximity of paper most easily catching fire when an excessive temperature rising occurs can be suppressed to a low temperature and heating can be focused on the proximity of the excessive temperature rising prevention device 30 for causing the excessive temperature rising prevention device 30 to operate more speedily and safely. At a continuous printing time at which the temperature of the excessive temperature rising prevention device 30 most rises during the normal operation, the heating roll 10 rotates to be uniformly heated, whereby malfunction of the excessive temperature rising prevention device 30 caused by excessive heating can be prevented.

The halogen heater 14 of the heating sources (halogen heaters 12 and 14) shown in FIG. 1 has a wider effective heating range than the halogen heater 12. In this case, the halogen heater 14 having the wider effective heating range is installed downstream in a rotation direction of the heating roll 10 viewed from the excessive temperature rising prevention device 30. Accordingly, the proximity of the heating source being at the highest temperature in a circumferential direction of the rotating heating roll 10 can be placed downstream in the rotation direction from a portion opposed to the excessive temperature rising prevention device 30 and consequently a setup temperature of the excessive temperature rising prevention device 30 during the normal operation can be lowered. Thus, while malfunction of the excessive temperature rising prevention device 30 during the normal operation is prevented, the setup temperature of the excessive temperature rising prevention device 30 can be set low. The excessive temperature rising prevention device 30 is placed near the heating roll 10, whereby the safety when an excessive temperature rising occurs can be enhanced. As the setup temperature of the excessive temperature rising prevention device 30 is set low, a reduction in cost can be accomplished.

Figure 2:
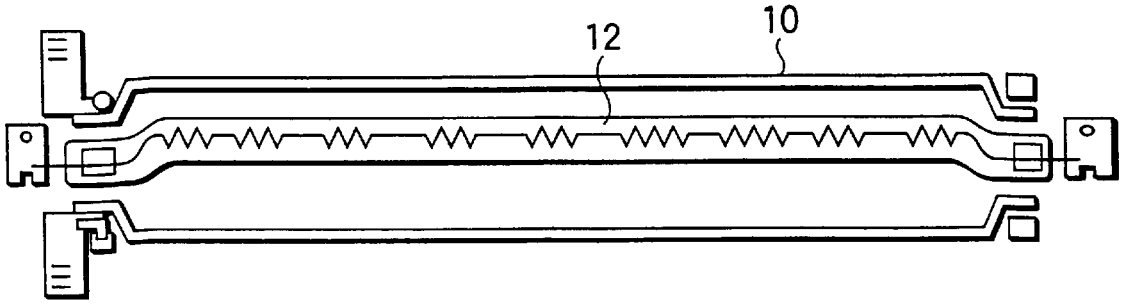
FIG. 2 is a longitudinal sectional view of a heating roll of an embodiment.

FIG. 2 is a longitudinal sectional view of heating roll 10 to show modified example of the first embodiment. The halogen heater 12 has a bend part in the proximity of both end parts thereof and the center line of the halogen heater 12 within a portion through which paper passes is eccentric to one side. The eccentric part is brought closely to the excessive temperature rising prevention device side (not shown). This example is useful for the case where a contraction part having a small diameter exists at both end parts of the heating roll 10 or the like.

Figure 3:
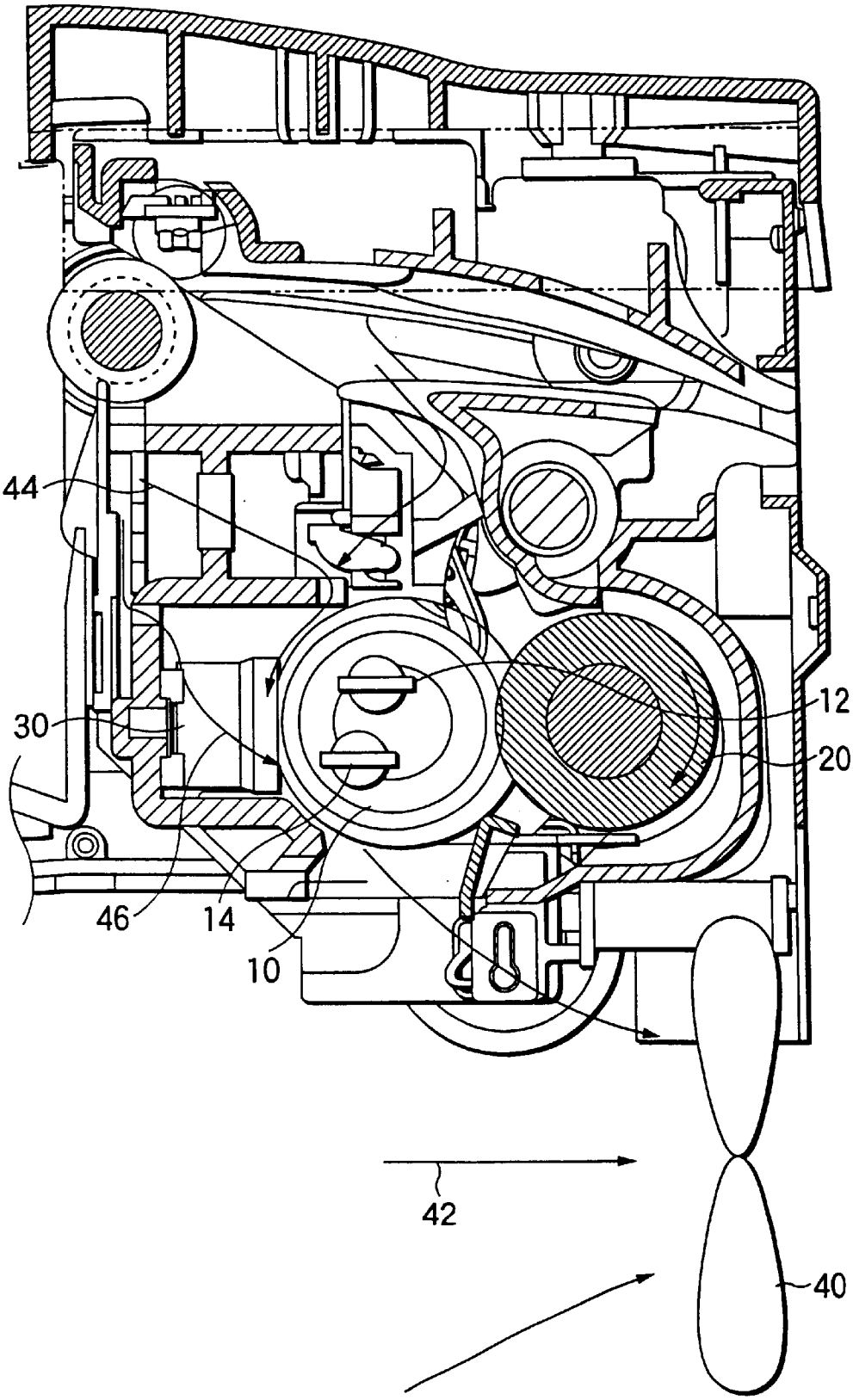
FIG. 3 is a sectional view of a fuser of an embodiment.
Figure 4:
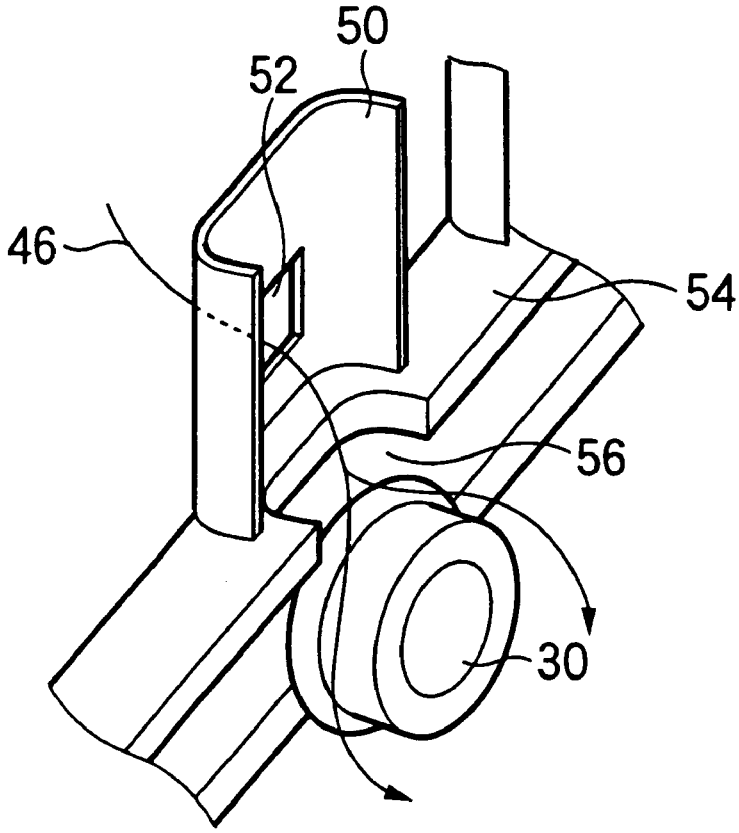
FIG. 4 is a perspective view of the proximity of an excessive temperature rising prevention device of an embodiment.

FIG. 3 is a sectional view of the proximity of heater to describe a flow passage of cooling air for cooling the proximity of the heating roll 10. In the heating roll 10, the halogen heaters 12 and 14 are placed closely to the excessive temperature rising prevention device 30. A fan 40 sucks cooling air 42 and cools the proximity of the heating roll 10. A cooling air passage is formed with a bypass, a hole piercing a partition wall, etc., so as to increase cooling air 44, 46 passing through the proximity of the excessive temperature rising prevention device 30. In order to describe this, FIG. 4 is a perspective view of the proximity of the excessive temperature rising prevention device 30. FIG. 4 shows a state in which a hole 52 is made in a partition wall 50 and a partition wall 54 is formed with a notch 56 so as to bypass a large amount of cooling air 46 as compared with other portions to the proximity of the excessive temperature rising prevention device 30.

As the cooling air flow amount in the proximity of the heating roll 10, the flow passage is thus shaped for making the amount of air passing through the proximity of the excessive temperature rising prevention device 30 larger than that through any other portion, whereby the temperature of the excessive temperature rising prevention device 30 during the normal operation can be lowered. In the state in which the heating roll 10 stops in the state in which paper is sandwiched between the heating roll 10 and the pressure member 20 as a problem arising particularly when an excessive temperature rising occurs, the sandwiched paper hinders air from flowing in the proximity of the excessive temperature rising prevention device 30 so that the heat of the excessive temperature rising prevention device 30 is not taken. Accordingly, the temperature of the excessive temperature rising prevention device 30 can be promptly raised as intended and the excessive temperature rising prevention device 30 can be operated more speedily and safely.

Next, to stop the image formation process halfway, if the heating roll 10 is stopped at the same time as the power to the heating source is shut down, the temperature of the heating roll 10 overshoots because of the characteristic of the heating source. Then, a sequence controller for shutting down the power to the heating source and stopping rotation of the heating roll 10 after expiration of a predetermined time interval is provided. The predetermined time interval can be set properly by timer setting. The sequence controller makes it possible to prevent the temperature of the heating roll 10 from overshooting and to lower the temperature of the excessive temperature rising prevention device 30 just after a paper jam is detected. Therefore, while malfunction of the excessive temperature rising prevention device 30 during the normal operation is prevented, the setup temperature of the excessive temperature rising prevention device 30 can be set low. The excessive temperature rising prevention device 30 can be placed near the heating roll 10 so that the safety when an excessive temperature rising occurs can be enhanced. As the setup temperature of the excessive temperature rising prevention device 30 is set low, a reduction in cost can be accomplished.

Figure 5:
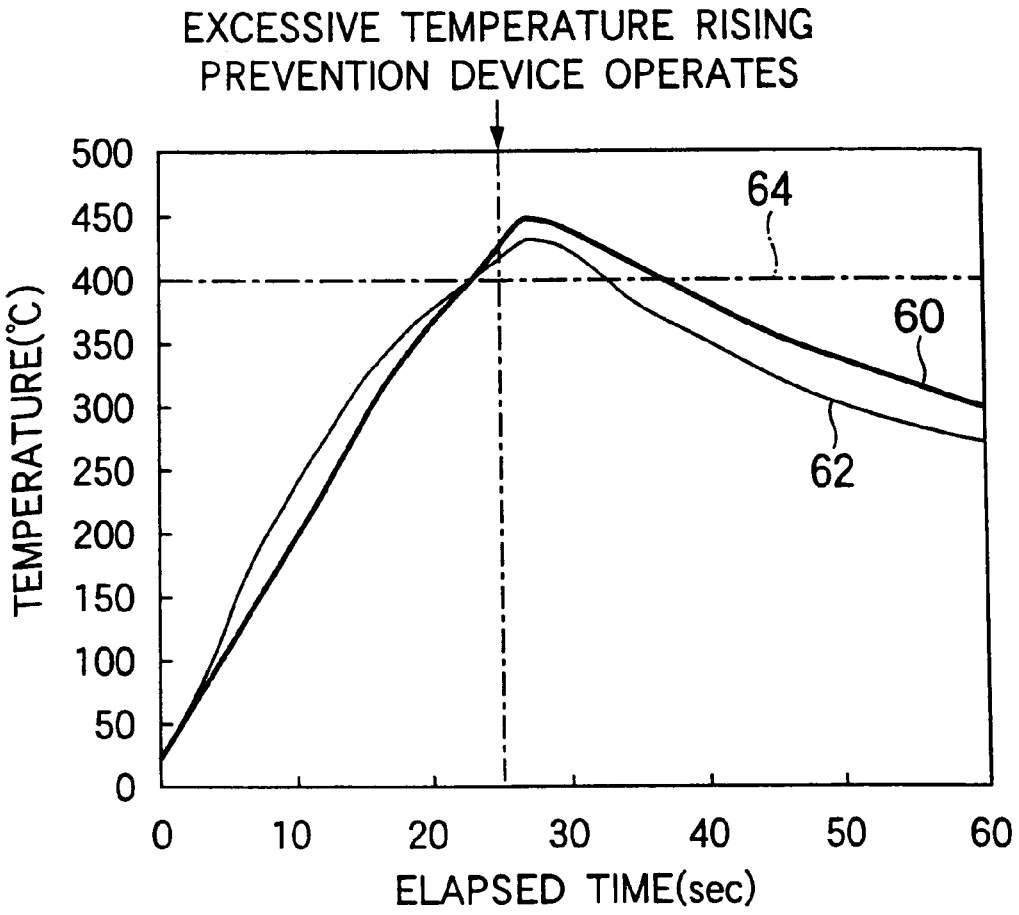
FIG. 5 is a chart to show the progression of heating roll temperature over time when an excessive temperature rising occurs in the related art.
Figure 6:
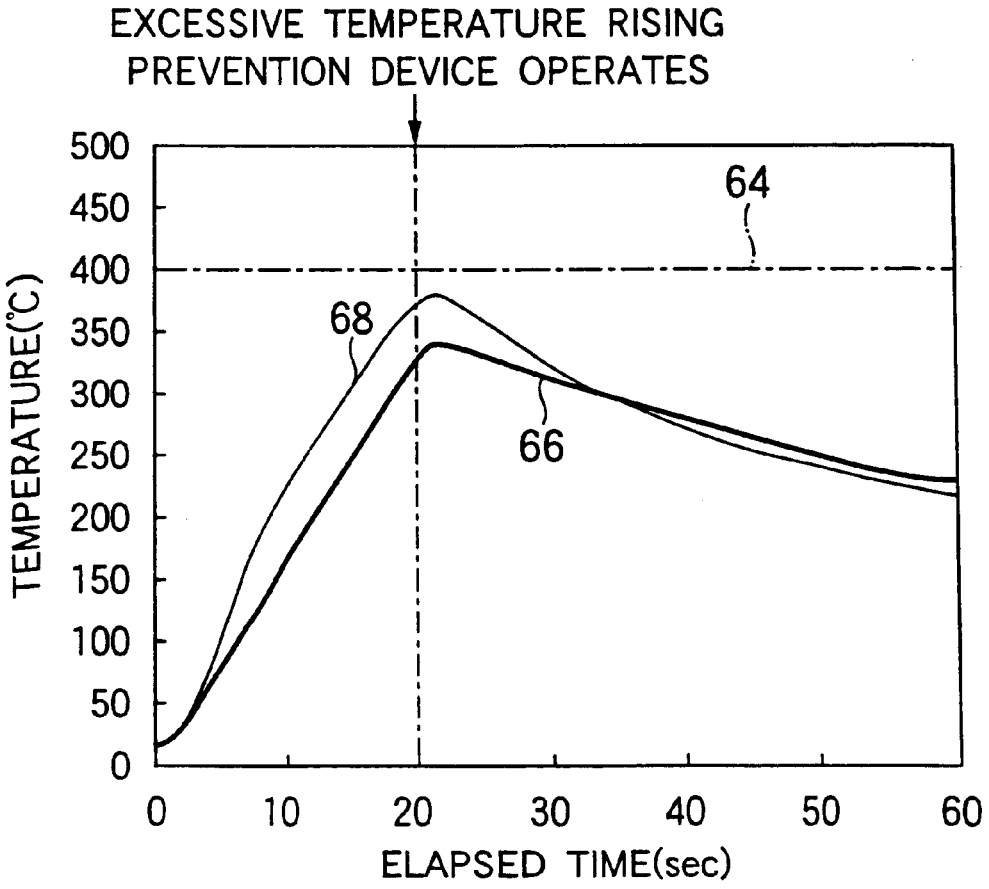
FIG. 6 is a chart to show the progression of heating roll temperature over time when an excessive temperature rising occurs in the embodiment.

The advantages of the first embodiment of the invention will be discussed with reference to FIGS. 5 to 9. FIG. 5 shows the progression of the heating roll temperature when an excessive temperature rising (temperature controller failure) occurs in the related art wherein the heating source (750-W halogen heater) is placed at the center of the heating roll. Paper nip side temperature 60 and excessive temperature rising prevention device temperature 62 rise rapidly and lower as the excessive temperature rising prevention device operates. At this time, the paper nip side temperature 60 reaches 450° C. and the excessive temperature rising prevention device temperature 62 also reaches 436° C. The paper nip side temperature 60 exceeds paper-catching-fire danger temperature 64 (about 400° C.). FIG. 6 shows the progression of the heating roll temperature according to the first embodiment of the invention when an excessive temperature rising (temperature controller failure) occurs wherein a 750-W halogen heater is used as the heating source as well as in FIG. 5. The halogen heater is placed closely to the excessive temperature rising prevention device 3 mm from the center of the heating roll. In this case, paper nip side temperature 66 becomes a maximum value of 342° C. and excessive temperature rising prevention device temperature 68 becomes a maximum value of 386° C. The paper nip side temperature 60 does not reach the paper-catching-fire danger temperature 64 (about 400° C.).

Figure 7:
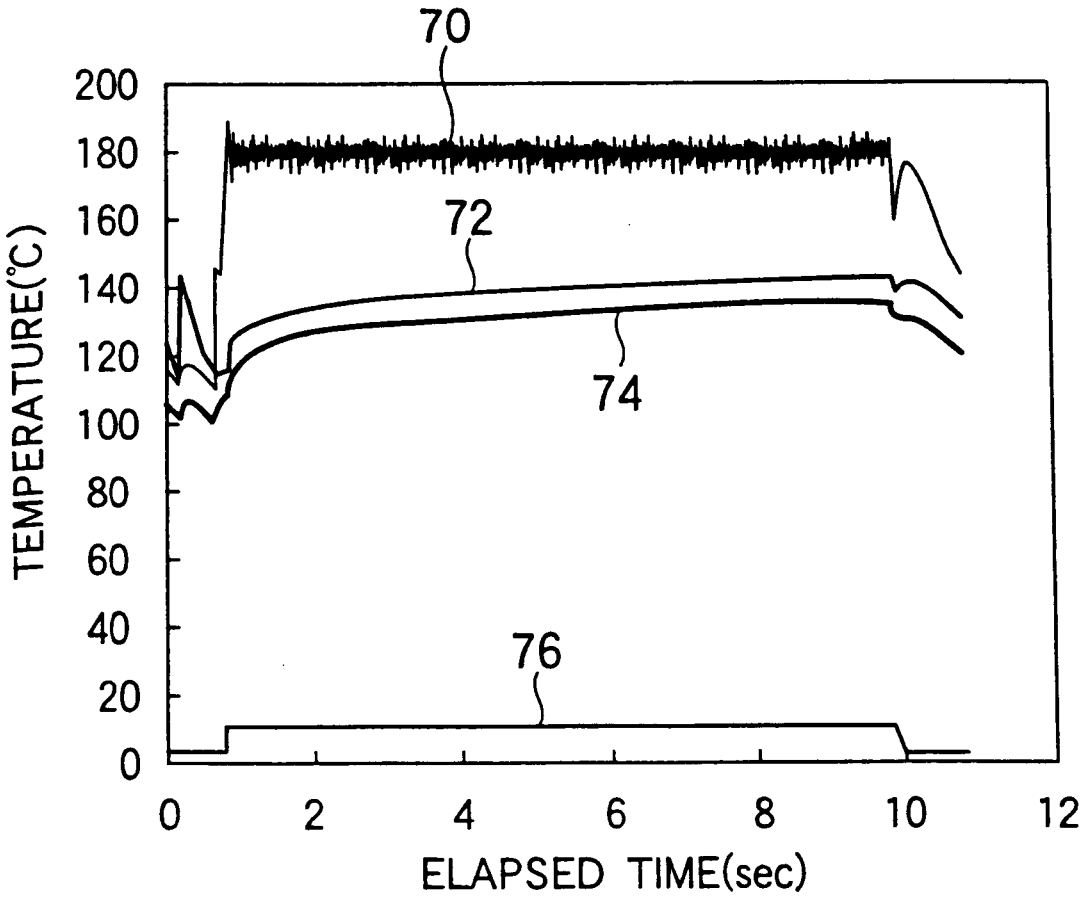
FIG. 7 is a chart to show the progression of excessive temperature rising prevention device temperature over time in the embodiment.

FIG. 7 shows the progression of the temperature of the excessive temperature rising prevention device over time when 250 sheets of A3-size paper were printed in the first embodiment of the invention. FIG. 7 shows heating roll temperature 70 at the time of the operation of the fuser 76. Here, the operation of the fuser denotes rotation of the heating roll. FIG. 7 also shows temperature 72 when the cooling air amount in the proximity of the excessive temperature rising prevention device is small and temperature 74 when the cooling air amount is large when a 750-W halogen heater is installed upstream and when a 500-W halogen heater is installed downstream. The excessive temperature rising prevention device temperature 72 indicates 143.6° C. at the maximum and the excessive temperature rising prevention device temperature 74 becomes 135.4° C. at the maximum; the improvement effect is 8.2° C.

Figure 8:
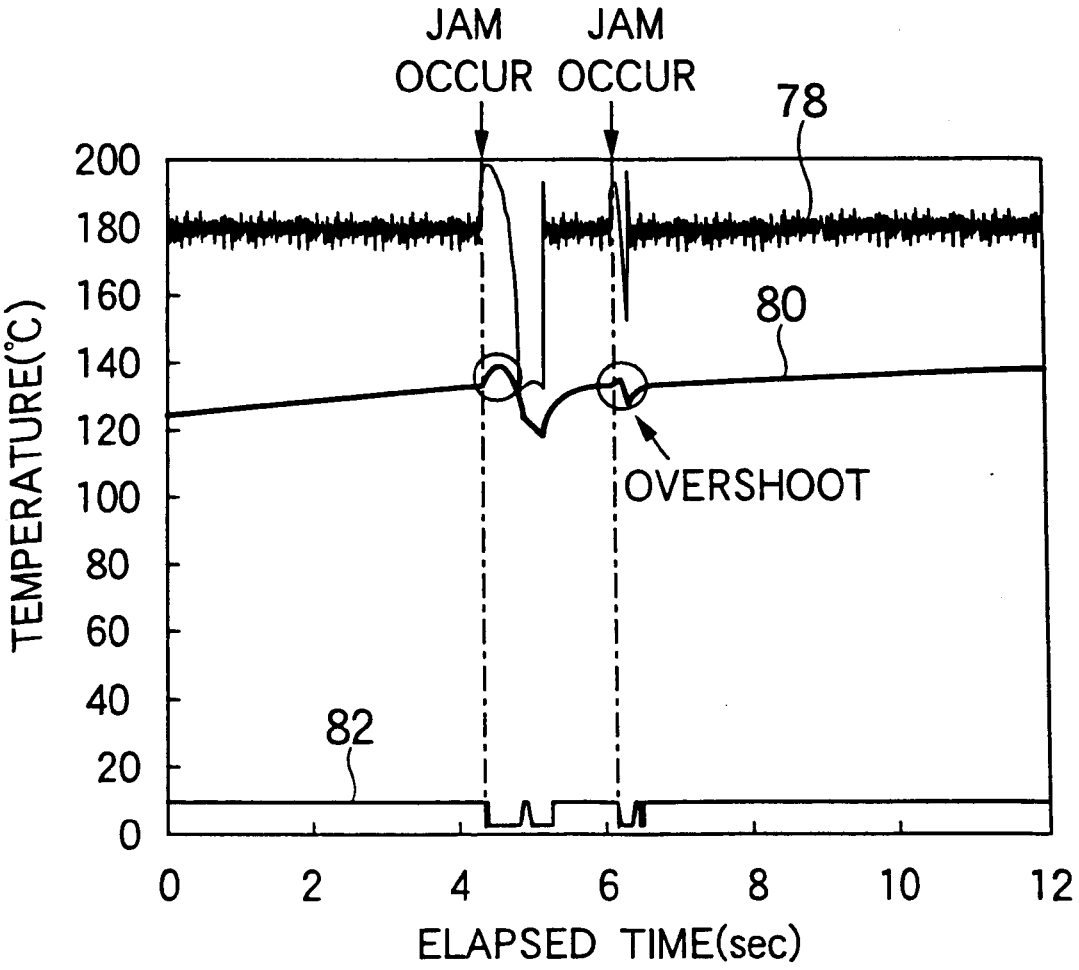
FIG. 8 is a chart to show the progression of heating roll temperature over time when a paper jam occurs in the related art.
Figure 9:
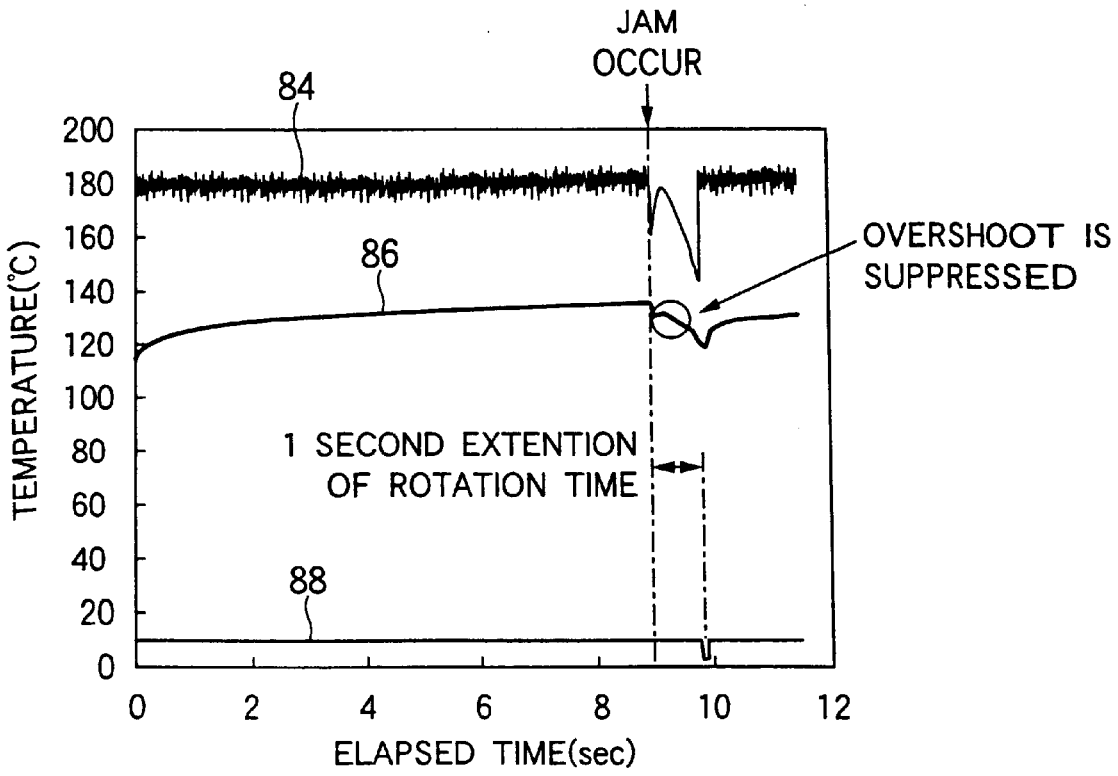
FIG. 9 is a chart to show the progression of heating roll temperature over time when a paper jam occurs in the embodiment.

FIG. 8 shows the temperature progression of the excessive temperature rising prevention device when a paper jam occurs in the related art, wherein rotation of the heating roll is stopped at the same time as the paper jam occurs. After the heating roll is stopped as the paper jam occurs, heating roll temperature 78 rises and excessive temperature rising prevention device temperature 80 also fluctuates accordingly as shown in the figure. The operation of the fuser is as indicated in 82. FIG. 9 shows the temperature progression when a paper jam occurs after improvement, wherein rotation of the heating roll is continued for one second after the paper jam occurs. The heating roll temperature is improved as indicated in 84, the excessive temperature rising prevention device temperature is improved as indicated in 86, and the operation of the fuser is improved as indicated in 88.

Second Embodiment

Figure 11:
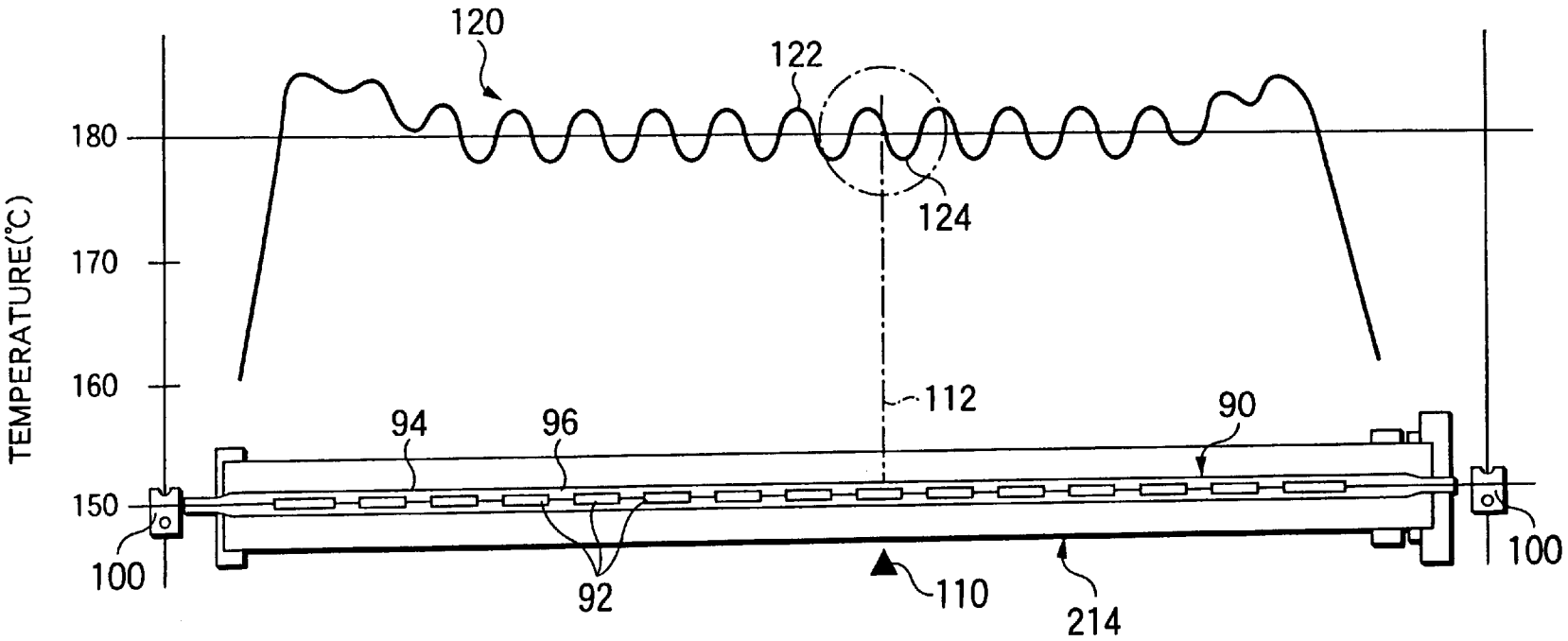
FIG. 11 is a schematic representation of a related art example.

Next, the second embodiment of the invention will be discussed. FIG. 11 is a schematic representation of a related art example; FIG. 11 shows a halogen heater 90, a heating roll 214 containing the halogen heater 90, and a curve 120 (light distribution ripple 120) indicating a surface light distribution graph along an axial direction of the heating roll. The surface temperature graph takes a length direction of the halogen heater 90 as a horizontal axis and the direction at the right angle to the length direction as a vertical axis; the temperature level on the vertical axis is indicated. As the halogen heater 90, a filament 92 provided by winding tungsten wire like a sparse and dense spiral is sealed in a seal tube 94 and is hermetically sealed together with halogen gas 96 and is connected at each end to a power supply terminal 100. The light distribution ripple 120 is shaped locally up and down and is formed with a top 122 and a bottom 124. In FIG. 11, a temperature sensing member 110 is in contact with the outer face of the heating roll 214 for detecting the surface temperature of the heating roll 214. In FIG. 11, a temperature sensing part 112 of the temperature sensing member 110 is at a position not corresponding to any top 122 of the light distribution ripple 120 or any bottom 124. An average temperature of the curve 122 is controlled to be at 180° C.

Figure 10:
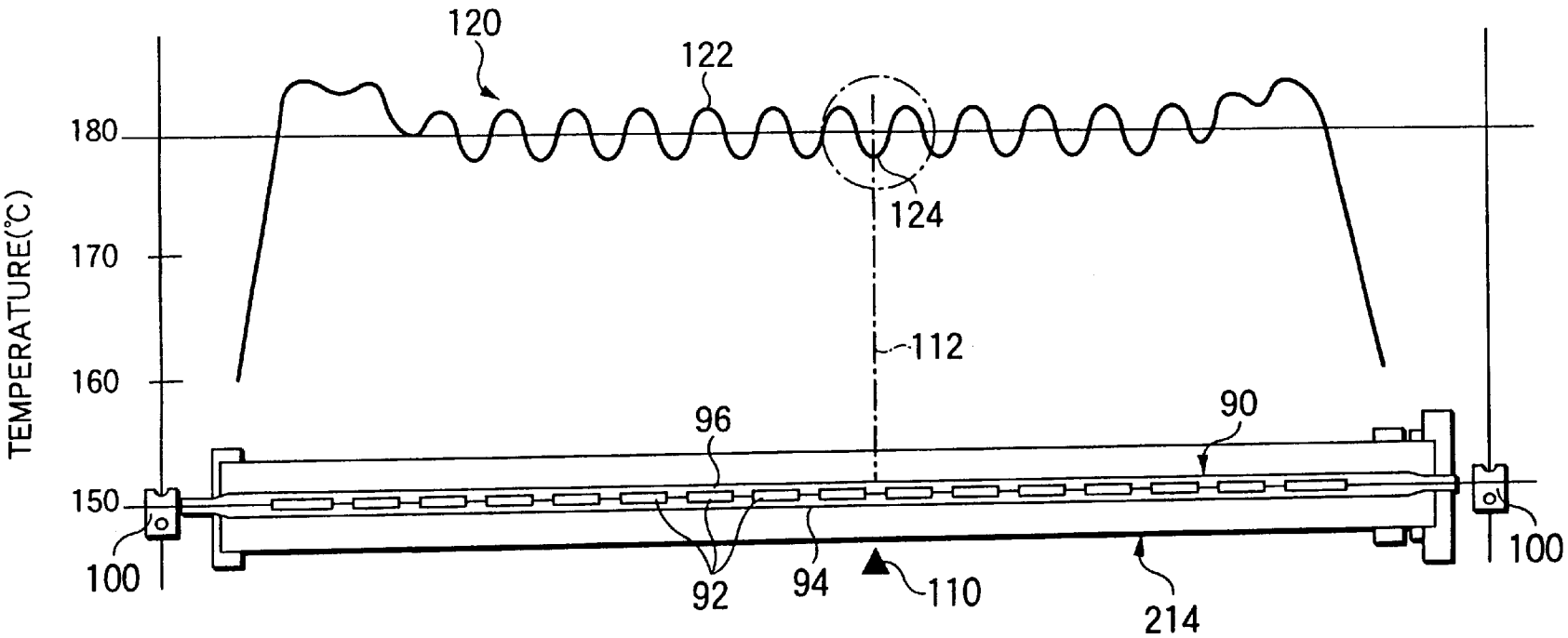
FIG. 10 is a schematic representation of an embodiment.

FIG. 10 is a schematic representation to describe the second embodiment of the invention and shows a halogen heater 90 and light distribution ripple 120 indicating a surface light distribution of a heating roll similar to those previously described with reference to FIG. 11. Reference numerals in FIG. 10 are similar to those in FIG. 11. The average temperature of the curve 122 shown in FIG. 10 is controlled to be at 178° C. In FIG. 10, the position of a temperature sensing member 110 matches the position corresponding to a bottom 124 of the light distribution ripple 120. In doing so, to control the temperature of the heating roll based on the sense temperature of the temperature sensing member 110, what is the detection temperature measured by the temperature sensing member 110 is made clear. Therefore, the accuracy of the temperature control can be improved. In FIG. 10, the part corresponding to the position of the temperature sensing member 110 matches the bottom 124 of the local light distribution ripple 120 in the axial direction of the halogen heater, but may be matched with a top 122.

Temperature change in the axial direction of the heating roll is small in the portion corresponding to the top 122 or the bottom 124 of the light distribution ripple 120. Thus, as in the invention, the position of the temperature sensing member 110 is positioned at a position of the top 122 or the bottom 124 of the local light distribution ripple 120 of the halogen heater 90 in the length direction, whereby if the position of the top 122 or the bottom 124 of the light distribution ripple 120 of the halogen heater 90 a little varies due to attachment looseness, etc., the heating roll temperature sensed by the temperature sensing member 110 is hard to be affected by the light distribution ripple 120.

Third Embodiment

Figure 12:
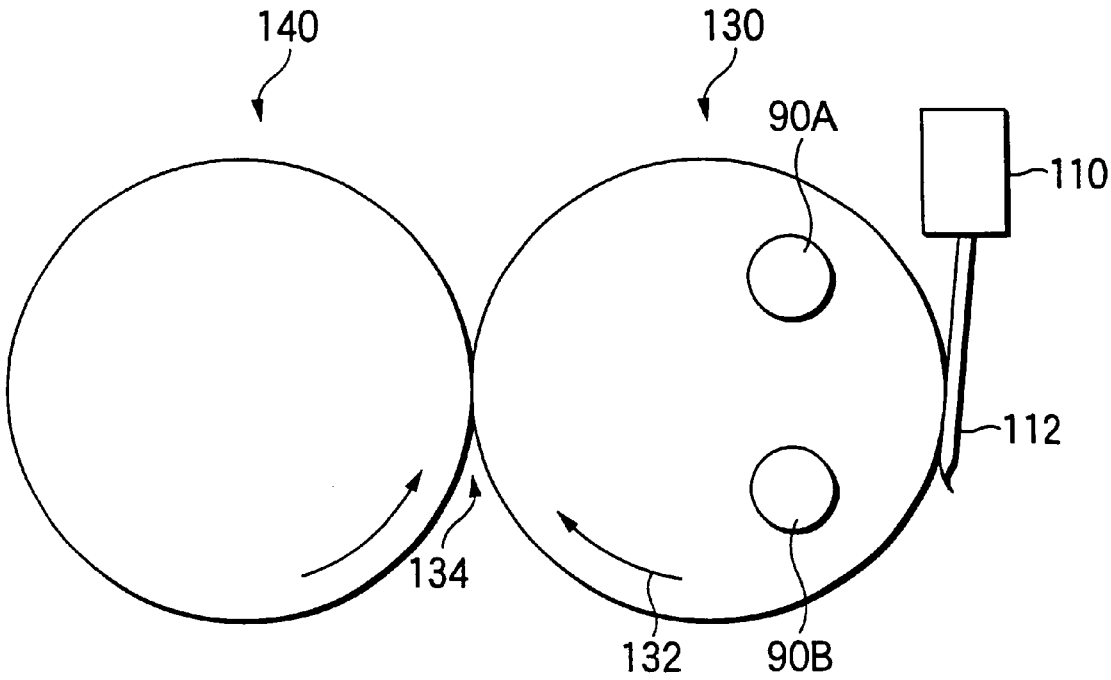
FIG. 12 is a sectional view of a heating roll and a pressure member.
Figure 13:
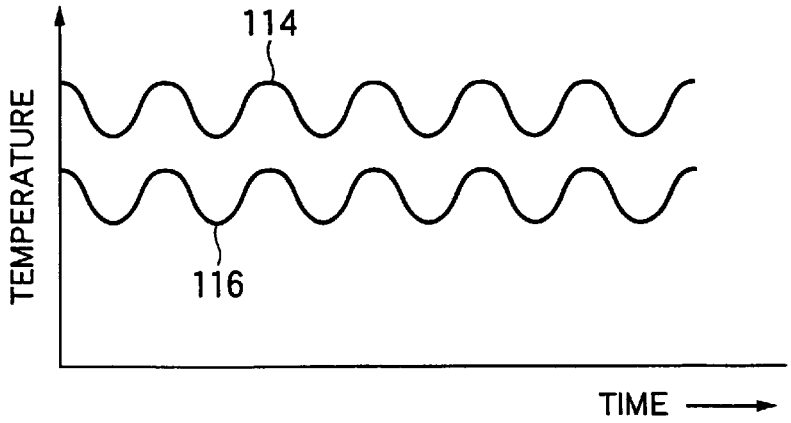
FIG. 13 is a graph to show the temperature progression of nip part.

Next, the third embodiment of the invention for fixing while changing a plurality of halogen heaters different in light distribution in response to the print conditions of the paper size, the number of print sheets of paper, etc., will be discussed with reference to FIG. 12. FIG. 12 is a transverse sectional view of a heating roll 130 and a pressure member 140. The heating roll 130 contains two halogen heaters 90A and 90B. For example, the halogen heater 90A has a narrow heating area and corresponds to narrow paper and the halogen heater 90B has a wide heating area and corresponds to wide paper. The halogen heaters 90A and 90B are changed for use in response to the print condition. The heating roll 130 rotates in a rotation direction 132 and the pressure member 140 is rotated to follow the rotation of the heating roll 130. The heating roll 130 and the pressure member 140 are pressed against each other and paper is caught in nip 134 therebetween and is passed through between the two rolls (heating roll 130 and pressure member 140). When the paper is passed through the nip 134, toner on the paper is thermally fused to the paper. A temperature sensing member 110 has a temperature detection part 112 brought into contact with the outer surface of the heating roll 130. In such placement, if the temperature sensing member 110 is placed corresponding to the bottom of a light distribution ripple for both the halogen heaters 90A and 90B, temperature 114 of the portion of the nip 134 becomes as shown in FIG. 13. That is, when the halogen heater 90B is used, the portion of the lowest temperature on the roll circumference (upstream from the halogen heater) is monitored and controlled and thus the temperature 114 of the nip 134 becomes high. In contrast, when the halogen heater 90A is used, the portion of the highest temperature on the roll circumference (downstream from the halogen heater) is monitored and controlled and thus temperature 116 of the nip 134 becomes low as shown in FIG. 13.

In contrast, in the third embodiment of the invention, in the above-mentioned placement, for the halogen heater 90A upstream in the rotation direction of the heating roll 130 viewed from the temperature sensing member 110, the bottom of local light distribution ripple in the axial direction is placed at the position corresponding to the temperature sensing member 110 and for the halogen heater 90B downstream in the rotation direction of the heating roll 130 viewed from the temperature sensing member, the top of local light distribution ripple in the axial direction is placed at the position corresponding to the temperature sensing member 110.

Figure 14:
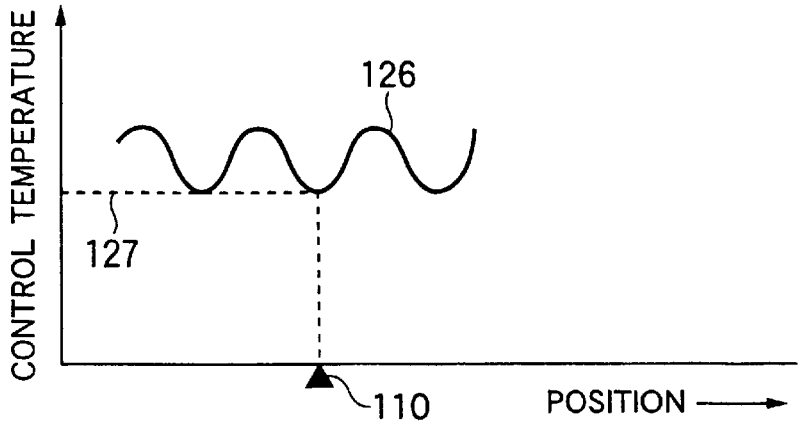
FIG. 14 is a graph to show temperature unevenness of light distribution ripple.
Figure 15:
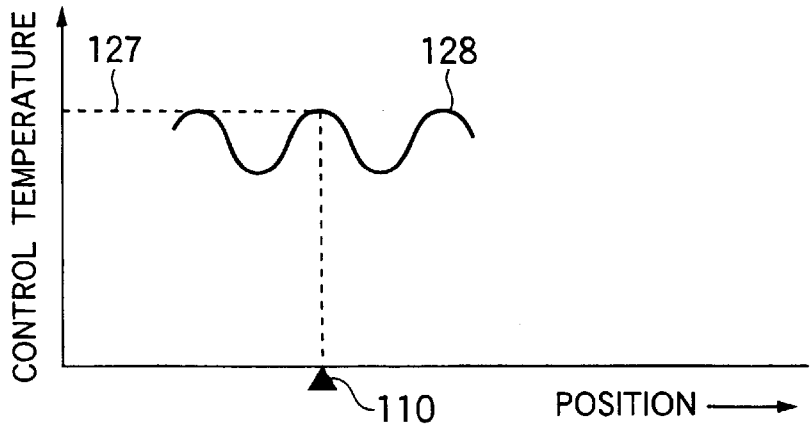
FIG. 15 is a graph to show temperature unevenness of light distribution ripple.

FIG. 14 shows a temperature unevenness curve 126 caused by the light distribution ripple produced by the halogen heater 90A. The position of the temperature sensing member 110 corresponds to the bottom of the light distribution ripple and the nip temperature is controlled based on control temperature 127. Therefore, the whole roll becomes higher temperature on average than the measurement temperature of the temperature sensing member 110. FIG. 15 shows a temperature unevenness curve 128 caused by the light distribution ripple produced by the halogen heater 90B. The position of the temperature sensing member 110 corresponds to the top of the light distribution ripple and the nip temperature is controlled based on the control temperature 127. Therefore, the whole roll becomes lower temperature on average than the measurement temperature of the temperature sensing member 110. That is, the temperature of the upstream halogen heater 90A is low as a whole and the heating roll 130 passes through the temperature sensing member 110 before reaching the nip. The temperature of the downstream halogen heater 90B is high as a whole and the heating roll 130 reaches the nip immediately. Therefore, the top and the bottom of the light distribution ripple are used as described above so that the effects previously described with reference to FIGS. 14 and 15 are made synergistic for making the nip temperature appropriate. Consequently, the sense temperature acts to make the control temperature appropriate, a fixing failure can be prevented, and the nip temperature can be optimized.

Fourth Embodiment

Figure 16:
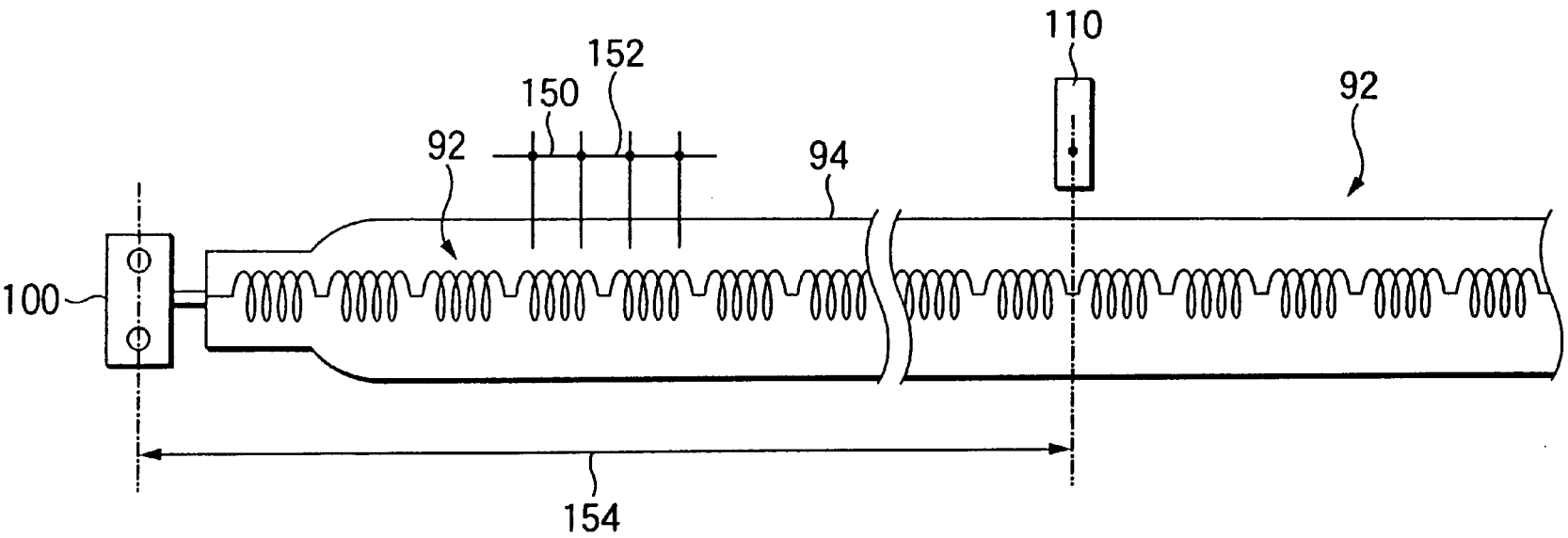
FIG. 16 is a drawing to show the configuration of a halogen heater.

Next, the fourth embodiment of the invention will be discussed. FIG. 16 is a fragmentary drawing of a halogen heater 90 of a heating source. In the halogen heater 90, a filament 92 is sealed in a seal tube 94 and comprises light emitting parts 150 and non-light emitting parts 152 placed alternately at almost equal intervals along the length direction of the halogen heater 90, and the light emission amount differs in the length direction. In this embodiment, the dimensions of the light emitting part 150 and that of the non-light emitting part 152 in the length direction of the halogen heater are each about 10 mm. A temperature sensing member 110 is disposed almost at the center of the halogen heater 90 in the length direction thereof. The position of the temperature sensing member 110 is at a given distance 154 from one terminal 100. The temperature sensing member 110 senses the temperature of the outer face of a heating roll containing the halogen heater 90. A temperature controller for controlling power of the halogen heater 90 based on the sensed temperature is provided.

Figure 17:
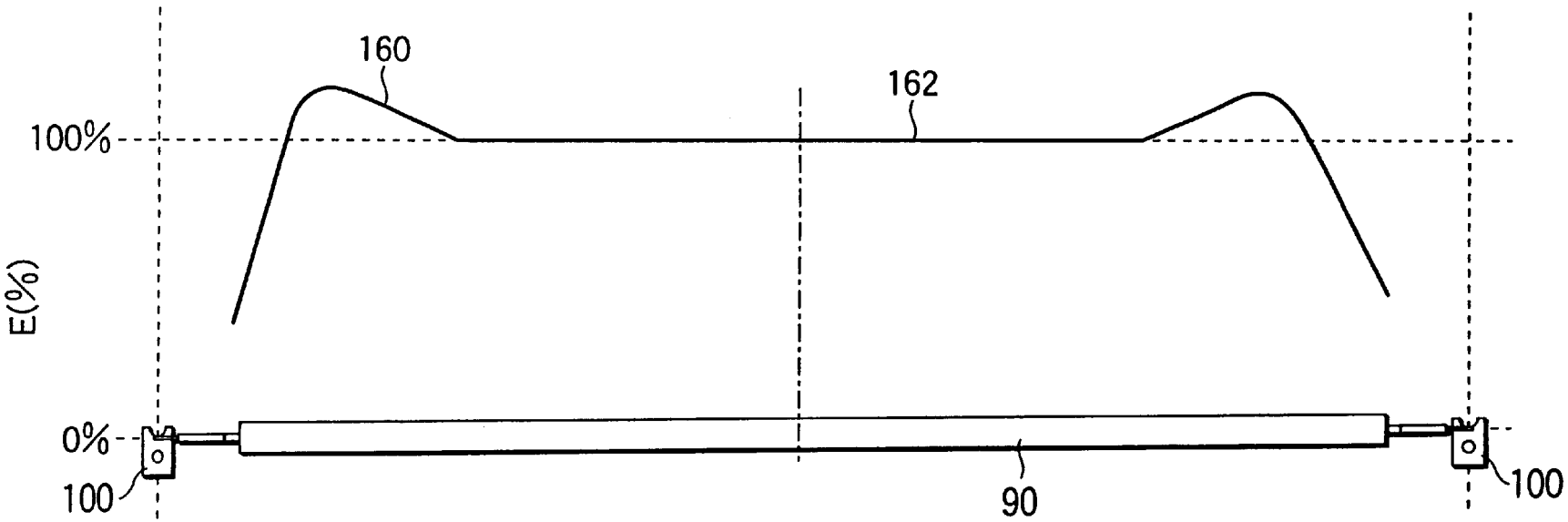
FIG. 17 is a schematic representation to show the light distribution strength of the halogen heater.
Figure 18:
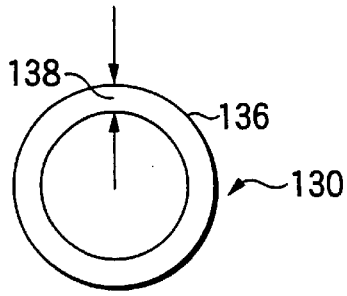
FIG. 18 is a sectional view of the center of the heating roll.

FIG. 17 is a drawing to show the halogen heater 90 and a light distribution curve 160 along the length direction of the halogen heater 90. The light distribution is indicated in E (%). The light distribution of a predetermined section of the center of the halogen heater 90 is made a predetermined value 162 and the temperature sensing member 110 is placed at the center thereof. FIG. 18 is a sectional view to show the transverse cross section of the area through which paper passes, of the center of a heating roll 130. In recent years, an art of thinning thickness 138 of a tubular body 136 of the area through which paper passes, of the heating roll 130 for shortening the warming-up time and saving energy has been adopted. The thickness 138 of the heating roll 130 formerly was about 0.7 mm, but the thinnest portion in the area through which paper passes is 0.5 mm or less and further recently the thickness has been thinned to about 0.2 mm. The thickness is to such an extent that a temperature gradient appears based on the light emission amount difference of the heating source (halogen heater) in the length direction of the heating roll in the proximity of the part where the temperature sensing member is placed.

Figure 19:
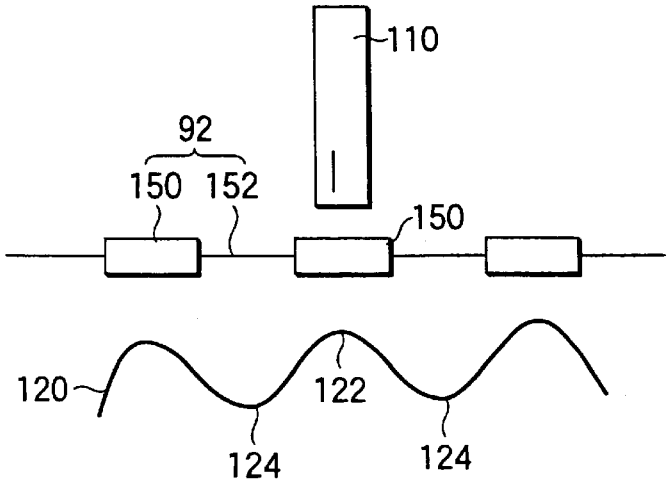
FIG. 19 is a drawing to show the placement relationship between the halogen heater and a temperature sensing member.
Figure 20:
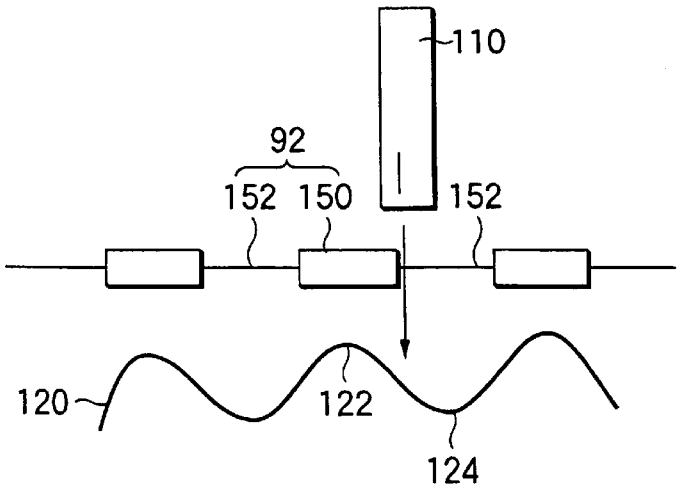
FIG. 20 is a drawing to show the placement relationship between the halogen heater and the temperature sensing member.

FIGS. 19 and 20 are schematic representations to schematically show on an enlarged scale the positional relationship between the position in the length direction of the filament 92 of the halogen heater 90 and the temperature sensing member 110 and also show light distribution ripple 120 corresponding to the light emitting part 150 and the non-light emitting part 152 of the filament 92. In FIG. 19, the temperature sensing member 110 is opposed to the light emitting part 150 of the filament 92 and is opposed to a top 122 of the light distribution ripple 120. In FIG. 20, the temperature sensing member 110 is opposed to a position out of the light emitting part 150 of the filament 92 and is opposed to a part between the top 122 and a bottom 124 of the light distribution ripple 120. The temperature gradient along the length direction of the filament 92 is moderate at the top 122 and the bottom 124 of the light distribution ripple 120 and abruptly changes between the top 122 and the bottom 124 of the light distribution ripple 120.

FIGS. 21 to 24 are charts to show the progression of roll temperature change with a lapse of time; they show roll temperature progression 172 and 174 when the same pulse input 170 is given to the same halogen heater. In the Figures, Lamp denotes the halogen heater and the pulse input 170 indicates the on/off operation of the halogen heater; the top is on and the bottom is off.

Figure 21:
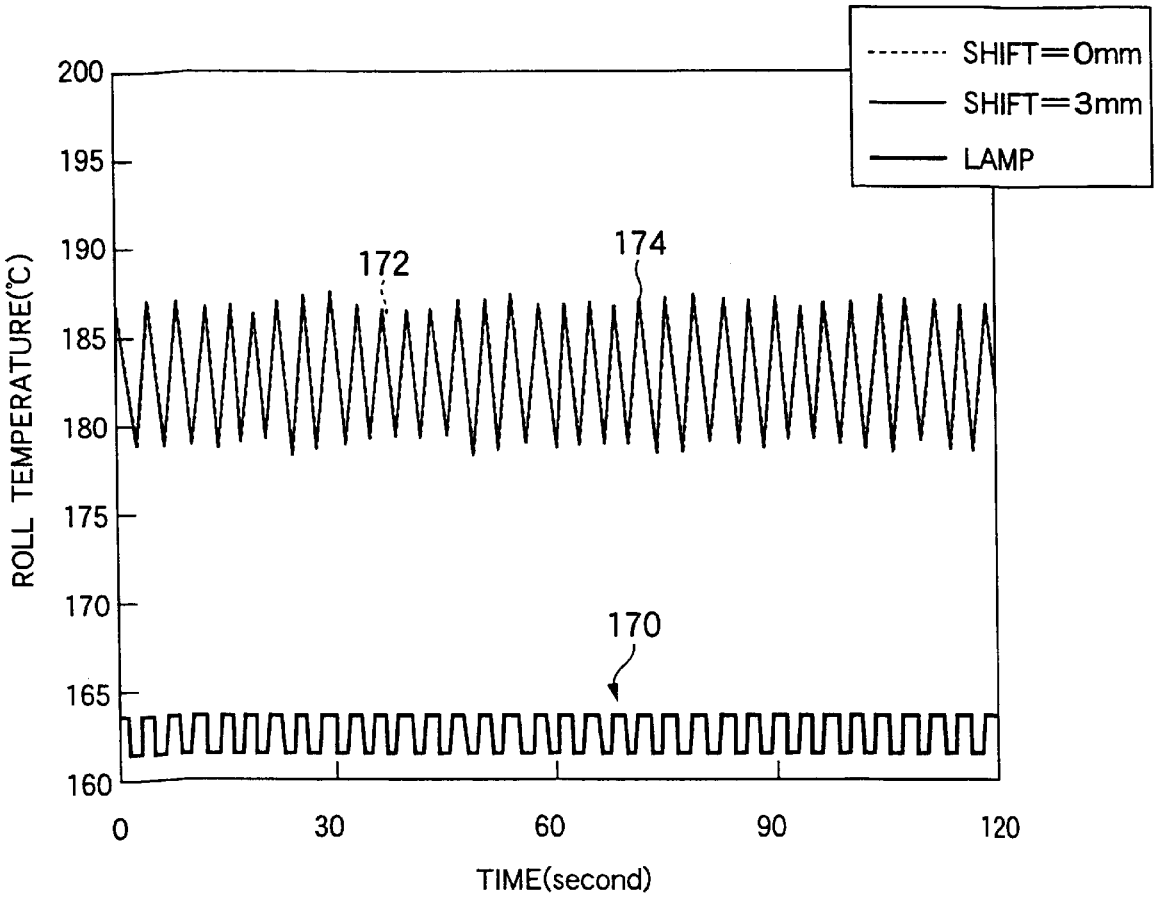
FIG. 21 is a surface temperature progression drawing of heating roll.

FIG. 21 shows the embodiment of the fourth embodiment of the invention; when the thickness of the heating roll is about 0.2 mm and the temperature sensing member is placed opposed to the top of the light distribution ripple and the opposed position matches the top (shift=0 mm), the temperature progression on the heating roll surface is indicated as 172 and when a position shift from that position occurs (shift=3 mm), the temperature progression on the heating roll surface is indicated as 174.

Figure 22:
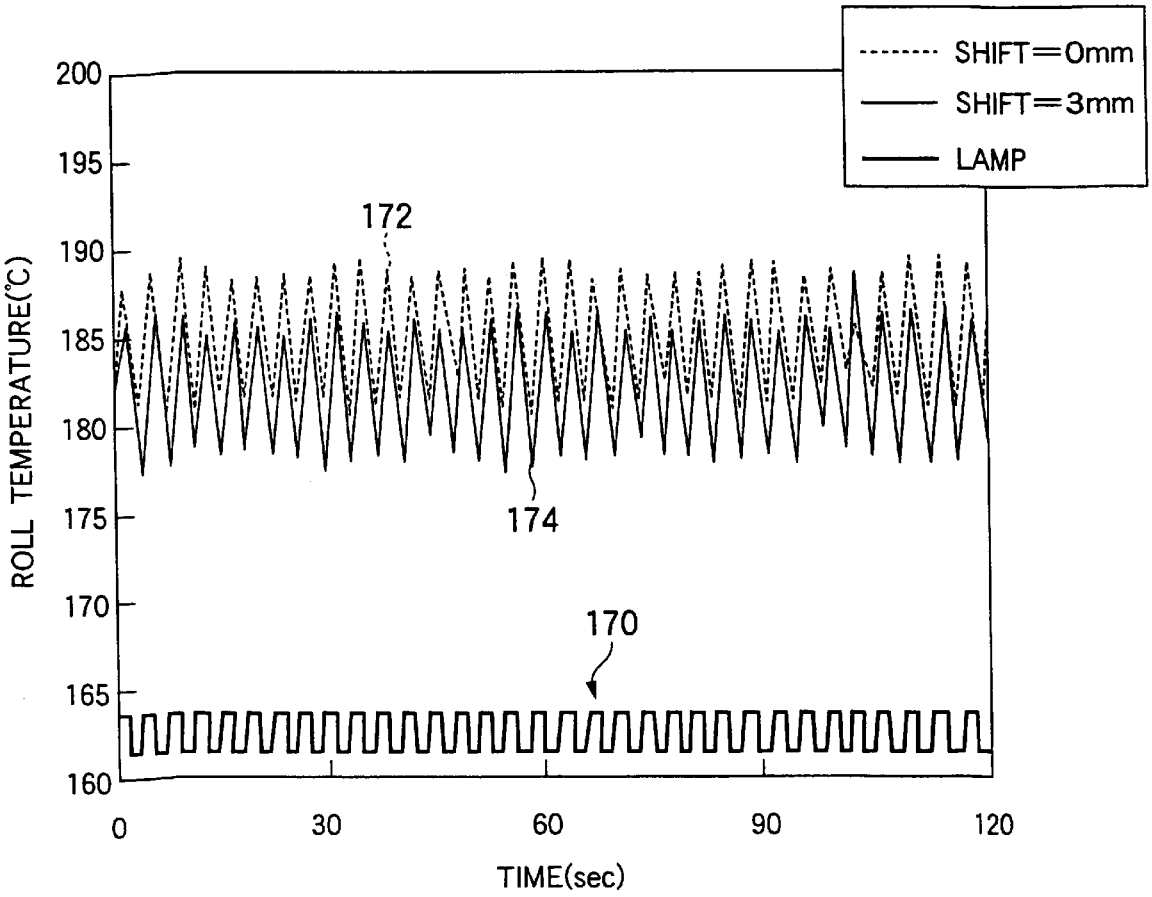
FIG. 22 is a surface temperature progression drawing of heating roll.

FIG. 22 shows a comparative example of the fourth embodiment of the invention; when the thickness of the heating roll is about 0.2 mm and the temperature sensing member is placed opposed to the middle (between the top and the bottom) of the light distribution ripple and the opposed position matches the middle (shift=0 mm), the temperature progression on the heating roll surface is indicated as 172 and when a position shift from that position occurs (shift=3 mm), the temperature progression on the heating roll surface is indicated as 174.

Figure 23:
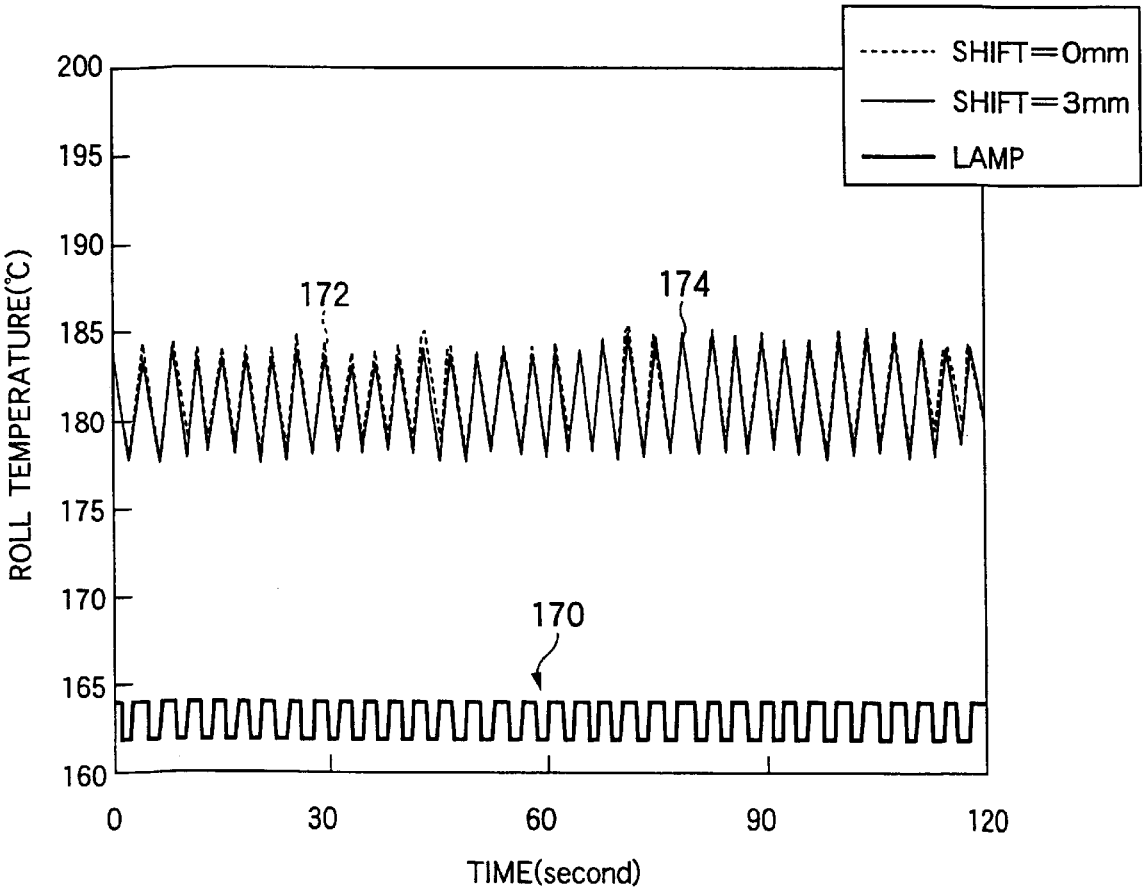
FIG. 23 is a surface temperature progression drawing of heating roll.
Figure 24:
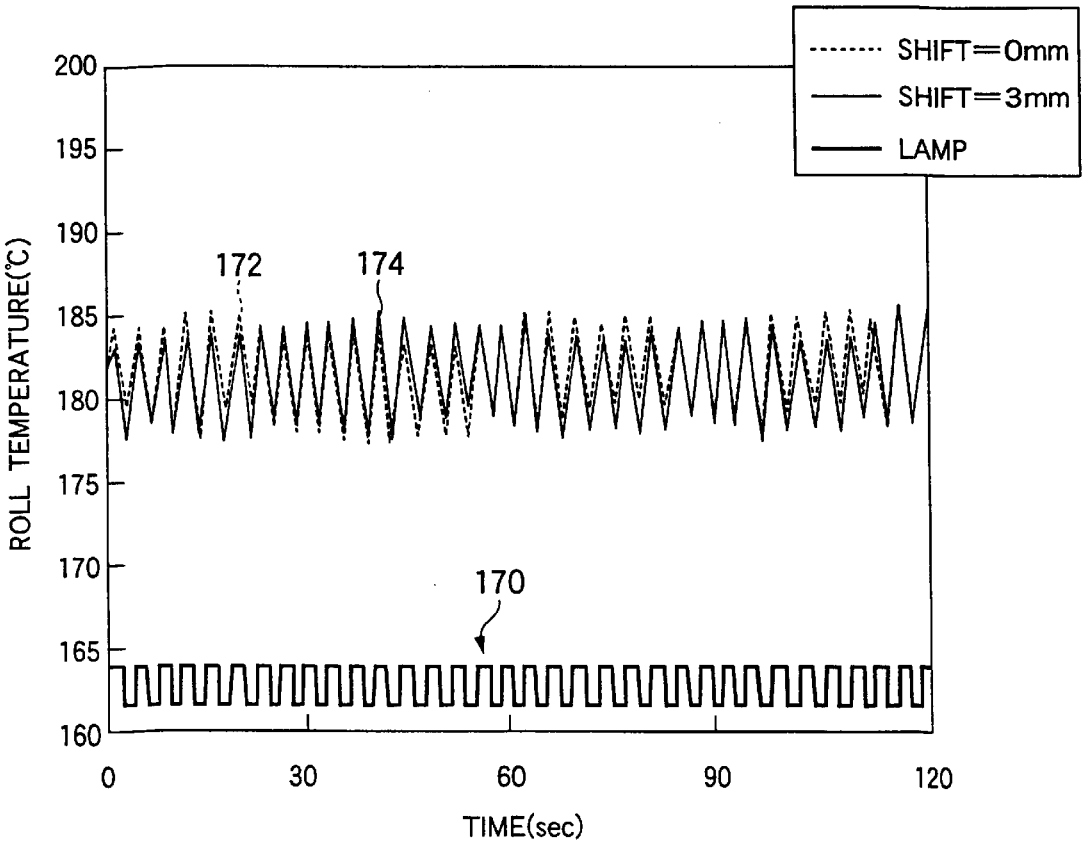
FIG. 24 is a surface temperature progression drawing of heating roll.

FIGS. 23 and 24 show related art examples corresponding to the examples in FIGS. 21 and 22 respectively; when the thickness of the heating roll is about 0.7 mm, in each of case that the temperature sensing member is placed opposed to the top of the light distribution ripple and that the temperature sensing member is placed opposed to the middle of the light distribution ripple, the opposed positions match the top and the middle (shift=0 mm), respectively, the temperature progression on the heating roll surface is indicated as 172 and when a position shift from that position occurs (shift=3 mm), the temperature progression on the heating roll surface is indicated as 174. As shown in FIGS. 23 and 24, when the thickness of the heating roll is 0.7 mm, namely, the heating roll is thick, if the temperature sensing member is placed out of the predetermined position, large change in the detection temperature is not observed.

In contrast, when the thickness of the heating roll is 0.2 mm, namely, the heating roll is thin, a large error occurs in the detection temperature depending on the positional relationship between the temperature sensing member and the halogen heater. When the temperature sensing member is placed opposed to the middle of the light distribution ripple (position where the temperature gradient is large) as shown in FIG. 22, if the temperature sensing member is placed out of the predetermined position, large change is observed in the detection temperature. In FIG. 22, when the temperature sensing member shifts 3 mm to the top side of the light distribution ripple (high-temperature side), the sense temperature of the temperature sensing member becomes high. In this case, temperature control is performed based on the high sense temperature of the temperature sensing member and thus the actual surface temperature of the heating roll lowers. On the other hand, if the temperature sensing member shifts to the bottom side of the light distribution ripple (low-temperature side), the actual surface temperature of the heating roll is controlled to a higher temperature than that with shift=0 mm.

In contrast, in the embodiment of the invention, as shown in FIG. 21, if the temperature sensing member is placed at a position where the temperature gradient is small, namely, is placed opposed to the top of the light distribution ripple, even if the temperature sensing member is placed out of the predetermined position, large change is not observed in the detection temperature. If the temperature sensing member is placed opposed to the bottom of the light distribution ripple, the temperature gradient is small and thus a similar result is produced.

As described above, even if the relative attachment position accuracy between the temperature sensing member and the halogen heater shifts 3 mm from the predetermined installation position because of a manufacturing error, an attachment error, etc., if the temperature sensing member is placed opposed to a position where the temperature gradient of the light distribution ripple of the halogen heater is low, a large difference does not appear in the sense temperature of the temperature sensing member and the surface temperature of the heating roll can be controlled to the previously intended temperature.

According to the invention, if the heating roll is thinned to lessen the heat capacity thereof, it is made possible to promptly prevent the temperature of the heater from abnormally rising without bringing the excessive temperature rising prevention device improperly closely to the heating roll or unreasonably lowering the setup operation temperature. It is also made possible to prevent the instability of temperature control accompanying change in the relative positional relationship between the filament and the temperature sensing member caused by variations in quality at mass production time of halogen heaters of image formation apparatus, etc.

To perform on/off control while selectively changing a plurality of halogen heaters different in light distribution, the rotation direction of the heating roll and the relative positional relationship between the temperature sensing member and the halogen heater are made appropriate, whereby it is made possible to prevent occurrence of a fixing failure or hot offset when the halogen heaters are changed.

Further, when the heating source different in light emission amount in the length direction is used and the heating roll is thinned, if the attachment accuracy of the heating source contains a small error, it is made possible to place the temperature control of the heating roll in a proper range.

What is claimed is:

1. A thermal fuser comprising:

a heating source;

a heating roll containing the heating source;

a pressure member disposed to press-contact with the heating roll;

a temperature sensing member for sensing temperature of the heating roll;

a temperature controller for controlling electric power supplied to the heating source based on the temperature sensed by the temperature sensing member; and an excessive temperature rising prevention device disposed in the proximity of the heating roll and connected in series to the heating source, wherein a distance between the excessive temperature rising prevention device and the heating source is smaller than that between the excessive temperature rising prevention device and the center of the heating roll.

2. The thermal fuser according to claim 1, wherein the heating source has bend parts in the proximity of both ends thereof;

a portion of the heating source through which paper passes is made eccentric; and the eccentric portion is disposed to be close to the excessive temperature rising prevention device side from the center of the heating roll.

3. The thermal fuser according to claim 1, wherein the heating source is a plurality of heating sources; and the heating source having larger heating value is disposed to be closer to the excessive temperature rising prevention device from the center of the heating roll.

4. The thermal fuser according to claim 1, wherein the heating source is a plurality of heating sources; and wherein the heating source having wider effective heating range is disposed more downstream in a rotation direction of the heating roll viewed from the excessive temperature rising prevention device.

5. The thermal fuser according to claim 1, wherein a flow passage shape for making the amount of cooling air passing through the proximity of the excessive temperature rising prevention device larger than that through any other portion is provided.

6. A thermal fuser comprising:

a heating roll containing a halogen heater;

a pressure member disposed to press-contact with the heating roll;

a temperature sensing member for sensing temperature of the heating roll; and a temperature controller for controlling electric power supplied to the halogen heater based on the temperature sensed by the temperature sensing member, wherein the thinnest portion of the heating roll in an area through which paper passes is not more than 0.5 mm; and a part of the halogen heater corresponding to a position of the temperature sensing member is positioned at one of a top and a bottom of a local light distribution ripple in an axial direction of the halogen heater.

7. The thermal fuser according to claim 6, wherein the halogen heater is a plurality of halogen heaters different in light distribution;

the halogen heaters are changed in response to print conditions;

for the halogen heater upstream in a rotation direction of the heating roll viewed from the temperature sensing member, the bottom of the local light distribution ripple in the axial direction is placed at the position corresponding to the temperature sensing member; and for the halogen heater downstream in the rotation direction of said heating roll viewed from said temperature sensing member, the top of the local light distribution ripple in the axial direction is placed at the position corresponding to the temperature sensing member.

8. A thermal fuser comprising:

a heating roll containing a heating source having difference in light emission amount in a length direction, a pressure member disposed to press-contact with the heating roll;

a temperature sensing member for sensing temperature of the heating roll; and a temperature controller for controlling electric power supplied to the heating source based on the temperature sensed by the temperature sensing member, wherein the thickness of an area of the heating roll through which paper passes is thin; and a part of the heating source corresponding to a position of the temperature sensing member is positioned at a part where a temperature gradient of the heating source is moderate.

9. The thermal fuser according to claim 8, wherein the thickness of the area through which paper passes is to such an extent that a temperature gradient appears based on the light emission amount difference of the heating source in the length direction of the heating roll in the proximity of the part where the temperature sensing member is placed.

10. The thermal fuser according claim 8 wherein as the thickness of the area through which paper passes, the thinnest portion in the area through which paper passes is not more than 0.5 mm.

11. An image forming apparatus comprising a thermal fuser including:

a heating roll containing a heating source having difference in light emission amount in a length direction, a pressure member disposed to press-contact with the heating roll;

a temperature sensing member for sensing temperature of the heating roll; and a temperature controller for controlling electric power supplied to the heating source based on the temperature sensed by the temperature sensing member, wherein the thickness of an area of the heating roll through which paper passes is thin;

a part of the heating source corresponding to a position of the temperature sensing member is positioned at a part where a temperature gradient of the heating source is moderate;

the heating source is a heater comprising light emitting parts and non-light emitting parts placed alternately in the length direction of the heating source and the part where the temperature gradient is moderate is a portion corresponding to one of the light emitting part and the non-light emitting part.

12. An image forming apparatus comprising a sequence controller for shutting down power supply of a heating source when an image formation process is stopped midway due to a malfunction and stopping rotation of a heating roll after expiration of a predetermined time interval.

* * * * *